US008219010B2

(12) United States Patent
Takahashi et al.

(10) Patent No.: US 8,219,010 B2
(45) Date of Patent: Jul. 10, 2012

(54) IMAGE FORMING APPARATUS, IMAGE FORMING METHOD, INTERMEDIATE TRANSFER BELT, AND METHOD OF EVALUATING THE SAME

(75) Inventors: Masashi Takahashi, Kanagawa-ken (JP); Minoru Yoshida, Tokyo (JP); Takeshi Watanabe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 439 days.

(21) Appl. No.: 12/499,213

(22) Filed: Jul. 8, 2009

(65) Prior Publication Data

US 2010/0008690 A1 Jan. 14, 2010

Related U.S. Application Data

(60) Provisional application No. 61/080,587, filed on Jul. 14, 2008.

(51) Int. Cl.
*G03G 15/01* (2006.01)
*G03G 15/20* (2006.01)
*G03G 21/00* (2006.01)

(52) U.S. Cl. ..... 399/302; 399/66; 399/67; 399/159

(58) Field of Classification Search ..... 399/66, 399/67, 107, 122, 159, 162, 297–299, 303, 399/308, 310, 312–314
See application file for complete search history.

(56) References Cited

U.S. PATENT DOCUMENTS

| | | | | |
|---|---|---|---|---|
| 2005/0058473 | A1 * | 3/2005 | Mizuno et al. | 399/302 |
| 2007/0127944 | A1 * | 6/2007 | Mochizuki | 399/101 |
| 2008/0232849 | A1 * | 9/2008 | Izutani et al. | 399/154 |

FOREIGN PATENT DOCUMENTS

| | | |
|---|---|---|
| JP | 2002-328484 | 11/2002 |
| JP | 2003-270970 | 9/2003 |
| JP | 3508078 | 1/2004 |
| JP | 2007-11295 | 1/2007 |

* cited by examiner

*Primary Examiner* — David Porta
*Assistant Examiner* — Jessica L Eley
(74) *Attorney, Agent, or Firm* — Turocy & Watson, LLP

(57) ABSTRACT

In an image forming apparatus which transfers a toner image formed on a photoconductive member primarily onto the intermediate transfer belt and then transfers the same secondarily onto an image bearing medium, a relation; $40<F\times R\times L<1\times10^4$ ($N\Omega cm^2$), where F(N) is an average adhesion between the intermediate transfer belt and toner, R (Ωcm) is a resistivity, and L(cm) is a thickness of the intermediate transfer belt is satisfied.

15 Claims, 6 Drawing Sheets

| INTERMEDIATE TRANSFER BELT | MOVING VELOCITY V | DEVELOPER | | ADHESION F | F·L·R | F·L·ε | F·V | SECONDARY TRANSFER EFFICIENCY | QUANTITY OF REVERSELY TRANSFERRED TONER |
|---|---|---|---|---|---|---|---|---|---|
| | cm/sec | CARRIER | TONER | N | NΩcm2 | NΩcm | N·cm/sec | % | mg/cm2 |
| I | 15 | α | A | 4.60E-08 | 2.15E+03 | 1.30E+05 | 6.90E-07 | 93.7 | 15 |
| | | | B | 7.50E-09 | 3.51E+02 | 2.12E+04 | 1.13E-07 | 95.5 | 18 |
| | | | C | 7.20E-10 | 3.37E+01 | 2.04E+03 | 1.08E-08 | 95.5 | 20 |
| | | | D | 3.00E-10 | 1.40E+01 | 8.49E+02 | 4.50E-09 | 96 | 30 |
| | 7 | β | A | 2.60E-08 | 1.22E+03 | 7.36E+04 | 1.82E-07 | 93.4 | 12 |
| | | | B | 7.50E-09 | 3.51E+02 | 2.12E+04 | 5.25E-08 | 94.5 | 14 |
| | | | C | 2.45E-09 | 1.15E+02 | 6.93E+03 | 1.72E-08 | 95 | 16 |
| | | | D | 5.35E-10 | 2.50E+01 | 1.51E+03 | 3.75E-09 | 97 | 35 |
| II | 15 | α | A | 1.40E-07 | 1.71E+04 | 1.29E+06 | 2.10E-06 | 88 | 10 |
| | | | B | 3.00E-07 | 3.67E+04 | 2.75E+06 | 4.50E-06 | 85 | 9 |
| | | | C | 9.20E-09 | 1.13E+03 | 8.45E+04 | 1.38E-07 | 93 | 16 |
| | | | D | 6.80E-08 | 8.32E+03 | 6.24E+05 | 1.02E-06 | 91.5 | 14 |
| | 7 | β | A | 1.50E-07 | 1.84E+04 | 1.38E+06 | 1.05E-06 | 88.6 | 8 |
| | | | B | 2.50E-07 | 3.06E+04 | 2.30E+06 | 1.75E-06 | 85.5 | 12 |
| | | | C | 1.30E-08 | 1.59E+03 | 1.19E+05 | 9.10E-08 | 92.2 | 13 |
| | | | D | 9.12E-08 | 1.12E+04 | 8.37E+05 | 6.38E-07 | 91.8 | 15 |
| III | 15 | α | A | 8.00E-07 | 1.41E+05 | 1.14E+07 | 1.20E-05 | 82 | 8 |
| | | | B | 7.00E-07 | 1.23E+05 | 1.00E+07 | 1.05E-05 | 81 | 6 |
| | | | C | 4.00E-07 | 7.06E+04 | 5.71E+06 | 6.00E-06 | 83.8 | 8 |
| | | | D | 2.00E-07 | 3.53E+04 | 2.86E+06 | 3.00E-06 | 86 | 9 |
| | 7 | β | A | 8.00E-07 | 1.41E+05 | 1.14E+07 | 5.60E-06 | 82.5 | 4 |
| | | | B | 7.00E-07 | 1.23E+05 | 1.00E+07 | 4.90E-06 | 82 | 7 |
| | | | C | 4.00E-07 | 7.06E+04 | 5.71E+06 | 2.80E-06 | 84.3 | 11 |
| | | | D | 2.00E-07 | 3.53E+04 | 2.86E+06 | 1.40E-06 | 84 | 10 |

| INTERMEDIATE TRANSFER BELT | MATERIAL | THICKNESS (L) cm | RESISTIVITY (R) Ωcm | DIELECTRIC CONSTANT (ε) |
|---|---|---|---|---|
| I | HARD FLUORINE | 0.038 | 1.23E+12 | 2.3 |
| II | SOFT FLUORINE | 0.036 | 3.40E+12 | 2.7 |
| III | URETHANE | 0.042 | 4.20E+12 | 3.4 |

FIG. 4

IMAGE FORMING APPARATUS, IMAGE FORMING METHOD, INTERMEDIATE TRANSFER BELT, AND METHOD OF EVALUATING THE SAME

CROSS-REFERENCE TO RELATED APPLICATIONS

This application is based upon and claims the benefit of priority from U.S. provisional application 61/080587, filed on Jul. 14, 2008, the entire contents of each of which are incorporated herein by reference.

TECHNICAL FIELD

The present invention relates to an image forming technology configured to form an image on a photoconductive member by charged toner, primarily transfer the image onto an intermediate transfer belt and then secondarily transfer the image onto a paper and, more specifically, to the intermediate transfer belt and a method of evaluating the same.

BACKGROUND

In a color image forming apparatus, a tandem type intermediate transfer method in which developing units configured to form toner images respectively in three primary colors (Y; yellow, M; magenta, and C; cyan) and black (Bk; black) are-arranged in sequence, the respective color toner images are overprinted at one pass on the intermediate transfer belt (primary transfer), then the overprinted color toner images are transferred in block to the paper (secondary transfer) is currently in vogue because of its superiority in high-speed printing.

In the color image forming apparatus in which the tandem-type intermediate transfer method is employed, a secondary transfer efficiency of the color toner images to the paper is not high under any circumstances as matters now stand. Therefore, there are problems such that the images may be deteriorated or uneven transfer may occur due to defect of transferred colorant or scattering of toner.

In the color image forming apparatus as such, the toner transferred from the developing unit on an upstream side to the intermediate transfer belt may be reversely transferred to the photoconductive member of the developing unit on a downstream side. In this case, there arises a problem of variations in density or hue of the image outputted onto the paper.

In addition, the image forming apparatus in a cleaner-less specification has a problem such that the reverse transfer as described above causes toner on the upstream side to be mixed with developer stored in the developing unit on the downstream side, thereby varying the hue of the toner image formed by the developing unit on the downstream side.

Improvement in the secondary transfer efficiency and restraint of the reverse transfer are mutually contradictory in benefit, and hence making the harmonized relation of these requirements clear is an important subject to study for the improvement of the quality of output images.

In contrast, a study focusing on an adhesion of the toner was conducted, and a method of deriving the adhesion of the toner quantitatively from a centrifugal force when toner particles are separated from a substance where the toner used to adhere using a centrifugal separator is proposed (for example, JP-A-2002-328484).

Also, a preferable range of the adhesion for achieving a technical element for improving the quality of the output images is reported (for example, Japanese Patent No. 3508078, JP-A-2003-270970). However, these are still in an extent such that the lower the adhesion between the belt and the toner, the better it becomes as a countermeasure for defects of a belt cleaning.

Therefore, it can be said that there is no report in which the conditions to achieve both the improvement of the secondary transfer efficiency and the restraint of the reverse transfer are studied in conjunction with the adhesion of the toner.

SUMMARY

In view of such circumstances, it is an object of the invention to provide an image forming apparatus in which the quality of output images is improved by defining the relation between a measured value of the adhesion of toner and a physical property value of an intermediate transfer belt and related technologies thereof.

In order to achieve the object described above, an intermediate transfer belt according to an embodiment of the invention is used in an image forming apparatus which transfers a toner image formed on a photoconductive member primarily onto the intermediate transfer belt and then transfers the same secondarily onto a paper, and satisfies a relational expression; $40\ (N\Omega cm^2)<F\times R\times L<1\times10^4\ (N\Omega cm^2)$, where F(N) is an average adhesion between the intermediate transfer belt and the toner, R(Ωcm) is a resistivity, and L(cm) is a thickness of the intermediate transfer belt.

DESCRIPTION OF THE DRAWINGS

In the attached drawings;

FIG. 4 is a measurement result of the toner adhesion inspection device;

DETAILED DESCRIPTION

Referring now to the attached drawings, an embodiment of the invention will be described.

Figure 1:
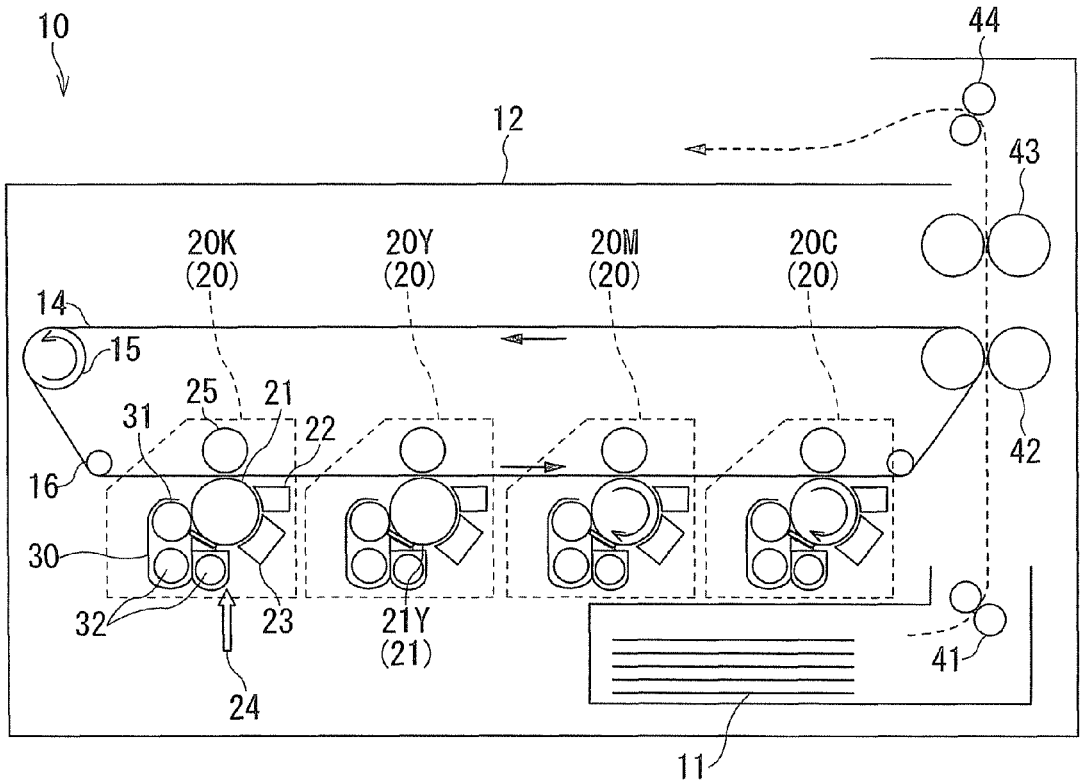
FIG. 1 is a schematic drawing showing an embodiment of an image forming apparatus according to the invention.

As shown in FIG. 1, an image forming apparatus 10 includes an intermediate transfer belt 14 configured to rotate along a trajectory defined by a drive wheel 15 and a driven wheel 16 at a predetermined moving velocity V, developing units 20 (20K, 20Y, 20M, 20C) configured to transfer toner images in respective colors onto the intermediate transfer belt 14 in a superimposed manner, a paper cassette 11 configured to store papers (image bearing medium) in a bunch, paper feed rollers 41 configured to distribute papers one by one from the paper cassette 11, secondary transfer rollers 42 configured to transfer a color toner images overprinted on the intermediate transfer belt 14 onto the distributed paper, fixing rollers 43 configured to fix the color toner images transferred to the distributed paper onto a paper surface, and paper discharge rollers 44 configured to guide the paper on which the toner images are fixed to a paper discharge tray 12.

The image forming apparatus 10 configured as described above is configured to print a color image reproduced by four colors; black K and three primary colors (yellow Y, magenta M, cyan C) on the basis of image data read by a scanner, not shown, or transferred from a terminal device.

The intermediate transfer belt 14 is an endless (seamless) belt having the substantially same length (width) as a photoconductive drum 21 in the direction orthogonal to a carrying direction (the depth direction in the drawing).

The intermediate transfer belt 14 is bridged between the drive wheel 15 rotating at a predetermined velocity and the several driven wheels 16 and the developing units 20 (20K, 20Y, 20M, 20C) in respective colors are arranged in sequence.

Then, the intermediate transfer belt 14 moves at the moving velocity V which is a same velocity as a circumferential velocity of the photoconductive drums 21 in the same direction, and the toner images of the respective colors (K, Y, M, C) adhering to the respective photoconductive drums 21 are overprinted and transferred thereon in sequence.

The intermediate transfer belt 14 has a laminated structure including a belt formed of polyimide resin as a base material, and an urethane rubber layer and a fluorine surface layer. The intermediate transfer belt 14 applied to the invention is not limited to a configuration having the laminated structure, and a case of a single layer is also included.

As an embodiment of the intermediate transfer belt 14 (see FIG. 4), three types in total of laminated belts including two types of a hard type (I) and a soft type (II) in which the nature of the fluorine is differentiated and a type (III) having an urethane layer as a surface layer were prototyped.

The type (I) formed of a hard fluorine material is 0.038 cm in total layer thickness L, $1.23\times10^{12}$ Ωcm in resistivity R, and 2.3 in dielectric constant.

The type (II) formed of a soft fluorine material is 0.036 cm in total layer thickness L, $3.40\times10^{12}$ Ωcm in resistivity R, and 2.7 in dielectric constant.

The type (III) formed of an urethane material is 0.042 cm in total layer thickness L, $4.20\times10^{12}$ Ωcm in resistivity R, and 3.4 in dielectric constant.

Referring back to FIG. 1, description will be continued.

The developing units 20 each include, along the direction of rotation around the photoconductive drum 21, a charger 23, an exposure device (not shown) configured to output an exposure light 24, a mixer 30 configured to stirs a developer by stirring screws 32 and cause the toner to adhere to a developing roller 31, a primary transfer roller 25 arranged at a position to nip the intermediate transfer belt 14 with the photoconductive drums 21, and a cleaner 22 configured to remove toner remaining on the photoconductive drums 21 without being transferred to the intermediate transfer belt 14.

The photoconductive drum 21 is a photoconductor formed into a cylindrical shape having a diameter of 30 mm and configured to rotate so as not to slip relatively with respect to the developing roller 31 and the intermediate transfer belt 14, and to change from an insulator to a conductor only in a portion which is subjected to the exposure light 24.

The charger 23 is a member to provide a voltage difference from 1 kV to 2 kV with respect to the photoconductive drum 21 to cause a corona discharge continuously to charge the surface of the photoconductive drums 21 uniformly to about −600 V by static electricity.

The exposure light 24 is outputted from the exposure device, not shown, and forms an electrostatic latent image according to an image to be formed on the uniformly charged surface of photoconductive drums 21.

In other words, irradiation of a laser beam from the exposure device is turned ON and OFF to form pattern images with and without static electricity corresponding to conductive and insulated areas formed on the surface of the photoconductive drums 21.

The mixer 30 stores the developer in any one of colors (black K, yellow Y, magenta M, and cyan C), and is configured to stir the toner together with a carrier and charge the same by the rotation of the stirring screws 32.

The developer here is a mixture of toner having particles of about 10 μm in diameter as color material and the carrier having particles of about 50 to 150 μm as magnetic particles such as iron particles or ferrite particles.

When only the toner is consumed by outputting the image by the image forming apparatus 10, and a toner concentration of the developer in the mixer 30 is lowered, new developer is supplied from a supply unit, not shown, and old developer is discharged and is collected into a recovery unit, not shown.

When the developer is stirred by the rotation of the stirring screws 32, the carrier and the toner are in friction with each other, so that the carrier is positively charged and the toner is negatively charged, whereby the toner is attracted by the carrier.

The developing roller 31 includes a magnet arranged in the interior thereof and, when the developing roller 31 rotates, the carrier stored in the mixer 30 is adsorbed on the surface of the developing roller 31 in association with the toner.

Then, a negative bias voltage of −380 V is applied on the developing roller 31 to form an electric field with respect to the photoconductive drums 21. In other words, the toner negatively charged by the electric field moves to a portion having no static electricity by being applied with the exposure light 24 in the surface of the photoconductive drums 21 formed with patterns with and without static electricity. In contrast, the toner cannot move to the portion with the static electricity in the surface of the photoconductive drums 21 because the direction of the electric field is inverted.

The primary transfer roller 25 is resiliently in abutment with the intermediate transfer belt 14 and the opposed photoconductive drums 21 by springs, not shown, provided at both ends thereof as urging means. The magnitude of an urging force by the springs is about 600 gft.

The primary transfer roller 25 is formed to have an outer diameter of ϕ18 mm by covering a side peripheral surface of a core metal having a diameter of ϕ10 mm with conductive foamed urethane containing carbon dispersed therein. An electric resistance between the core metal and the roller surface is about $10^7$Ω and a constant-voltage direct-current power source, not shown, is connected to the core metal.

If the primary transfer roller 25 is applied with a bias voltage of about +1 kV by the constant-voltage direct-current power source, the electric field with respect to the photoconductive drums 21 is formed. Then, by this electric field, the negatively charged toner on the photoconductive drum 21 is primarily transferred to the intermediate transfer belt 14.

Then, by increasing the bias voltage to be applied to the primary transfer rollers 25 in the respective developing units 20 (20K, 20Y, 20M, 20C) step by step in sequence of +1.0 kv, +1.2 kV, +1.4 kV, +1.6 kV, a toner image in a different color may be overlapped on a transferred toner image which is already transferred.

However, there might occur a problem such that the toner image transferred on the intermediate transfer belt 14 in the upstream developing unit 20 (20K) is transferred to the downstream photoconductive drum 21 of the developing unit 20 (20Y) reversely. In this case, the upstream side toner reversely transferred to the photoconductive drums 21 is removed by the cleaner 22, but a problem of variations in concentration or hue of the image outputted onto the paper occurs.

The paper cassette 11 is provided in a lower portion of the image forming apparatus 10 and stores the papers. In addition, the paper feed rollers 41 pick up the paper one by one from the paper cassette 11 and sends the same in the direction indicated by a broken line in the drawing.

The secondary transfer rollers 42 are members configured to transfer a multi-color toner image overprinted on the intermediate transfer belt 14 from the developing units 20 (20K, 20Y, 20M, 20C) further on a paper (image bearing medium).

The secondary transfer rollers 42 (secondarily) transfer the multi-color toner image in block from the intermediate transfer belt 14 onto the paper by the electric field formed by the application of a predetermined bias voltage between rollers opposing to each other with the intermediary of the intermediate transfer belt 14.

Here, if a secondary transfer efficiency of the color toner image from the intermediate transfer belt 14 to the paper is lowered, there arise problems such that the images may be deteriorated or uneven transfer may occur due to defect of transferred colorant or scattering of toner.

The fixing rollers 43 are members configured to fix the multicolor toner image by applying heat and pressure onto the paper on which the multicolor toner image is transferred, and fusing the toner to cause the same to intertwine with fibers of the paper. The paper on which the color image is formed is discharged onto the paper discharge tray 12 by the paper discharge rollers 44.

The reverse transfer from the intermediate transfer belt 14 to the photoconductive drums 21 described thus far gets involved with a non-electrostatic adhesion between them and the toner. Also, it can be said that the movement of the toner in the primary transfer from the photoconductive drums 21 to the intermediate transfer belt 14 and the secondary transfer from the intermediate transfer belt 14 to the paper significantly gets involved with the non-electrostatic adhesion as well as an electrostatic attracting force of the toner.

In addition, since a positive potential is applied from the secondary transfer rollers 42 to the intermediate transfer belt 14 in the secondary transfer, the intermediate transfer belt 14 is positively charged (charge-up). If the belt is charged up, the electrostatic attracting force acts on the negatively charged toner, which contributes to the lowering of the secondary transfer efficiency.

Therefore, the intermediate transfer belt 14 which improves the secondary transfer efficiency is preferably formed of material which allows electric charge to pass easily therethrough so as to resist the occurrence of the charge-up or to resolve the same in the early stage.

On the other hand, the reverse transfer occurs when the positive potential is applied to the intermediate transfer belt 14 from the primary transfer roller 25 and the negatively charged toner is reversely charged, so that a repulsive force with respect to the photoconductive drums 21 becomes lost.

Therefore, the intermediate transfer belt 14 for restraining the reverse transfer is preferably formed of material which hardly allows electric charge to pass therethrough.

In this manner, the characteristics to improve the secondary transfer efficiency and the characteristics to prevent the reverse transfer are requirements of characteristics which are mutually contradictory for the intermediate transfer belt 14.

Figure 2:
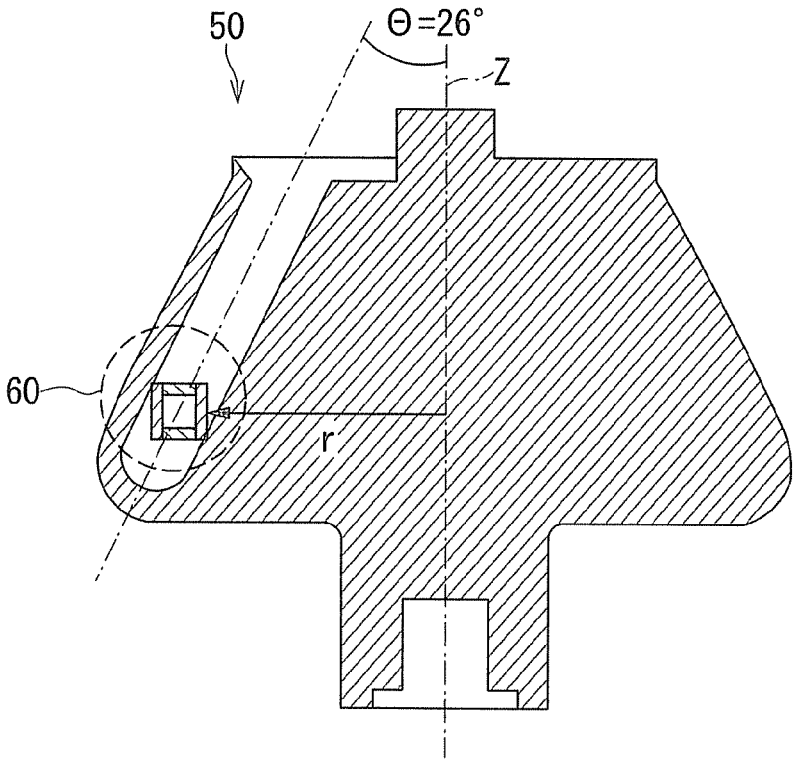
FIG. 2 is a cross-sectional view of a toner adhesion inspection device applied to a method of evaluating the image forming apparatus according to the invention.
Figure 3:
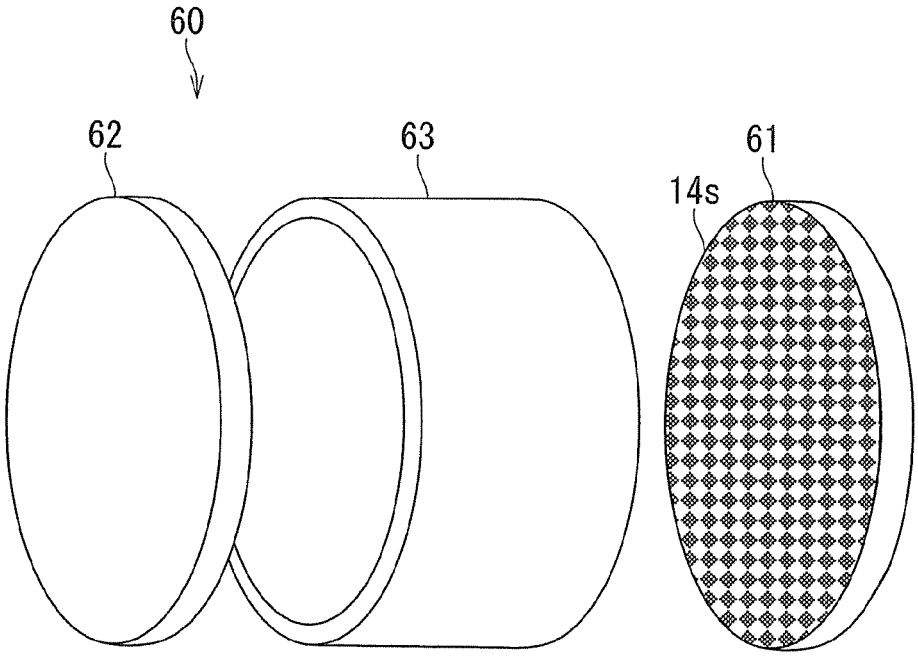
FIG. 3 is an enlarged drawing of a sample set which is set in the toner adhesion inspection device.

FIG. 2 is a cross-sectional view of an inspection device 50 of the adhesion of the toner applied to a method of evaluating the intermediate transfer belt 14 (FIG. 1). FIG. 3 is an enlarged drawing of a sample set 60 which is set in the inspection device 50.

The inspection device 50 is a centrifugal separator which rotates at a given rotational speed about an axis of rotation Z.

The sample set 60 is configured in such a manner that a sample fixing panel 61 and an opposed panel 62 are arranged in parallel to each other at both openings on both sides of a cylindrical spacer 63. Here, the diameter of the outer periphery of the sample set 60 is 7 mm, the thickness of the spacer 63 is 1 mm, and the height is 3 mm.

Then, the direction of the sample fixing panel 61 is directed inward so that the center axis of the spacer 63 is aligned with the direction of a radius r which is orthogonal to the axis of rotation Z of the inspection device 50 in order to prevent the sample set 60 from moving.

The adhesion of the toner is represented by a centrifugal force applied to toner particles when the rotational speed of the inspection device 50 is increased and the toner particles arranged on the surface of the sample fixing panel 61 fly toward the opposed panel 62.

The centrifugal force applied when the toner particles fly toward the opposed panel 62 as described above has a distribution for each toner particle. Therefore the adhesion of the toner is represented by an average value of the centrifugal forces in such distribution.

The procedure of preparing the sample set 60 and the procedure of inspection of an average adhesion F are as follows.

First of all, toner is transferred from the developing units 20 to the intermediate transfer belt 14 of the image forming apparatus 10 (FIG. 1), and part of the intermediate transfer belt 14 on which the toner is transferred is cut out as a sample 14*s*. Alternatively, it is also possible to prepare the sample 14*s* by transferring the toner to a small piece of the intermediate transfer belt 14 which is cut out in advance. However, since the average adhesion F is significantly affected by the quantity of charge of the toner, it is preferable to prepare the sample 14*s* in a method of adhesion which follows an actual process in order to measure with high degree of accuracy.

The sample 14*s* prepared in this manner is cut into a size of the sample fixing panel 61, and is bonded thereto with double-faced tape or the like.

The rotational speeds are set into ten phases from 10000 rpm to 100000 rpm at intervals of 10000 rpm. Here, ten of the sample sets 60 are prepared corresponding to the preset rotational speed phases.

The sample set 60 is set to achieve turning radius r=6 mm, and the inspection device 50 is rotated. Then, every time after the one rotational speed is achieved, the sample set 60 is taken out from the inspection device 50 and is replaced by another sample set 60. Then the rotational speed is changed and the operation of the centrifugal separation is continued.

In other words, if the charged toner is caused to adhere to the sample 14*s* and is rotated at a predetermined number of rotations, the toner particles are separated and fly toward the opposed panel 62 and adhere thereto when the centrifugal force exceeds the adhesion.

However, since the adhesion of the toner particles is not uniform, the toner particles are partly separated and adhere to the opposed panel 62, and remaining part thereof stays on the fixing panel 61.

Then, the number of rotations are increased step by step, and the quantities of separated toner and the quantities of remained toner at the respective numbers of rotations are measured and the ratios are obtained. By increasing the number of rotations until all the toner particles fly, the distribution of the adhesion of the toner is obtained.

The plurality of (ten) sample sets 60 subjected to the operation of the centrifugal separation by changing the rotational speed step by step are disassembled and the ratios between the quantities of toner flied and adhered to the opposed panels 62 and the quantities of toner remaining on the sample fixing panels 61 are determined.

The method of determining the quantities of the ratios between the flied toner and the remained toner is performed by separating the toner particles adhered to the opposed panel 62 and the sample fixing panel 61 and adhering the same on a white paper with a mending tape, and measuring a reflection densities by a Macbeth concentration meter.

When performing the measurement by the Macbeth concentration meter, in order to eliminate the influence of the tape or the white paper, a calibration expression for a taping concentration with respect to the quantities of the toner is prepared for an adequate compensation.

Then, a histogram representing the quantity distribution of the flied toner particles with respect to the respective preset rotational speeds is prepared.

The rotational speed represented by the lateral axis of the histogram may be converted into the centrifugal force applied to the toner, that is, the adhesion. The adhesion here is represented by a product of a relative centrifugal force (RCF) and a mass m of one toner particle as shown by the following expression.

[Expression 1]

$$\text{Adhesion}=\text{RCF}\times m(N) \quad (1)$$

[Expression 2]

$$\text{RCF}=1.118\times10^{-5}\times R\times N^2\times g(\text{m/s}^2) \quad (2)$$

R: distance from the center of rotation of the position of the sample set (=0.6 cm)

N: Rotational speed (rpm)

g: acceleration of gravity (N/kg)

[Expression 3]

$$m=(4/3)\pi\times r^3\times\rho\ (\text{kg}) \quad (3)$$

r: radius corresponding to sphere (m)

ρ: specific gravity of the toner (kg/m$^3$)

Then, the average adhesion F in the relation between the toner and the intermediate transfer belt 14 may be obtained from the histogram which represents the quantity distribution of the toner particles, which represents the adhesion on the lateral axis.

EXAMPLES

As shown in FIG. 4, eight types of developers obtained by combining carrier samples (α, β) and four toner samples (A, B, C, D) respectively were prototyped.

<Method of Prototyping Toner A>

First of all, 28 parts by weight of polyester resin, 7 parts by weight of Carmine 6B, 5 parts by weight of rice wax, and 1 part by weight of Carnauba wax were mixed by KNEADEX manufactured by YPK corporation to produce a master batch.

Then, this master batch was milled into rough fragments and added and mixed with 58 parts by weight of polyester resin and 1 part by weight of CCA, then milled into rough fragments, and then milled into fine fragments. The fragments of 8 μm or larger and those of 3 μm or smaller were eliminated by Elbow-jet classifier, so that colored resin particles having an average particle diameter of 5.3 μm were obtained.

Then, 3.5 parts by weight of silica having a primary particle diameter of 20 nm were added to 100 parts by weight of the colored resin particles and were mixed as an external additive using a Henschel mixer, so that toner A was obtained.

<Method of Prototyping Toner B>

Particles having a diameter of 0.5 μm were produced by emulsion polymerization with 65 parts by weight of styrene monomer, 21 parts by weight of acryl monomer, 6 parts by weight of rice wax, 7 parts by weight of Carmine 6B, and 1 part by weight of CCA, and were coagulated, cleaned, and dried, whereby colored resin particles having an average particle diameter of 5.4 μm (spherioidicity: 0.96) were obtained.

Then, 2.7 parts by weight of silica having the primary particle diameter of 25 μm and 0.5 part by weight of titanium oxide were added as the external additive to 100 parts by weight of the colored resin particles, so that toner B was obtained.

<Method of Prototyping Toner C>

Before adding silica as the external additive to the toner A, a mechanical conglobation process is performed to achieve a spherioidicity of 0.97 by suffusing process, and then 3 parts by weight of silica having the primary particle diameter of 20 μm was added thereto and mixed as the external additive using a Henschel mixer, so that toner C was obtained.

<Method of Prototyping Toner D>

After the colored resin particles of the toner B was coagulated and cleaned, 4 parts by weight of silica having the primary particle diameter of 20 μm was added to solvent and dispersed sufficiently, and then the colored resin particles after cleaning were added so that the silica particles were added externally to the surfaces thereof to form an uniform layer. Subsequently, the suspended silica was removed and dried, so that a toner D was obtained.

<Method of Prototyping Carrier α>

A silicon resin coating with carbon black dispersed therein is performed on a spherical ferrite core to achieve a surface resistance of $7\times10^8$ Ω/cm$^2$.

<Method of Prototyping Carrier β>

A fluorine contained resin coating with carbon black dispersed therein is performed on a spherical ferrite core to achieve the surface resistance of $1\times10^9$ Ω/cm$^2$.

Then, three types of intermediate transfer belts 14 having different surface materials (hardened fluorine type I, softened fluorine type II, urethane type III) were prototyped.

Then, the developer prototyped is filled in the mixer 30 of the image forming apparatus 10 (FIG. 1), the prototyped intermediate transfer belt 14 was set and the toner was caused to adhere thereto with the developing unit 20K.

Then, the quantity of toner (mg/cm$^2$) reversely transferred from the intermediate transfer belt 14 to the photoconductive drum 21Y when passing through the developing unit 20Y positioned on the downstream side was measured.

Furthermore, the quantity of transfer of the toner to the paper at the position of the secondary transfer rollers 42, and the remaining quantity on the intermediate transfer belt 14 were measured, and also the secondary transfer efficiency (%) was also studied.

Then, the intermediate transfer belt 14 having the toner adhering thereto in the developing unit 20K was cut out to obtain the sample 14*s* and the average adhesion F of the toner of each developer was measured using the inspection device 50 (FIG. 2).

The measurement of the average adhesion F was conducted at two velocities (15 cm/sec and 7 cm/sec) by switching the moving velocity V of the intermediate transfer belt 14 when causing the toner to adhere thereto.

Also, the thickness (L), the resistivity (R), and the dielectric constant (∈) of the each intermediate transfer belt 14 are to be obtained in advance by a known measuring method.

Here, the resistivity R×L is a parameter which indicates difficulty of passage of the electric charge per unit surface area of the belt. Therefore, the smaller value of R×L, which allows the easier passage of the electric charge, contributes more to the improvement of the secondary transfer efficiency, while the larger value of R×L contributes more to the restraint of the reverse transfer.

In contrast, the smaller average adhesion F contributes more to the improvement of the secondary transfer efficiency, while the larger average adhesion F contributes more to the restraint of the reverse transfer.

Therefore, it can be said that the image forming apparatus superior in both the secondary transfer characteristics and the reverse transfer characteristics is provided by setting the value of F×R×L to an optimal range.

FIG. 4 shows values of F×R×L in combinations of eight samples of developers and three samples of laminated intermediate transfer belts are shown.

Figure 5:
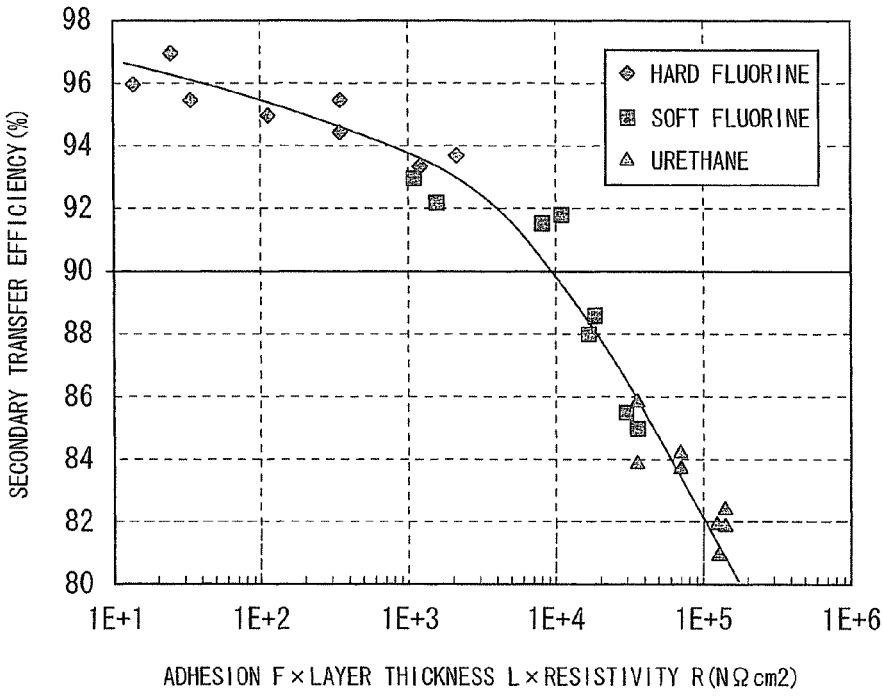
FIG. 5 is a graph showing a secondary transfer efficiency with respect to average adhesion F of toner × resistivity R of an intermediate transfer belt × thickness L of the intermediate transfer belt.

FIG. 5 is a graph showing a result of plotting the secondary transfer efficiency (%) with respect to the average adhesion F (N) of the toner×resistivity R (Ωcm) of the intermediate transfer belt×thickness L (cm) of the intermediate transfer belt.

From this result, information such that satisfaction of the following expression contributes to achieve a good correlation of the average adhesion F×resistivity R×thickness L with the secondary transfer efficiency and to achieve a secondary transfer efficiency of 90% or higher was obtained.

[Expression 4A]

$$F \times R \times L < 1 \times 10^4 \ (\mathrm{N\Omega cm^2}) \tag{4A}$$

Figure 6:
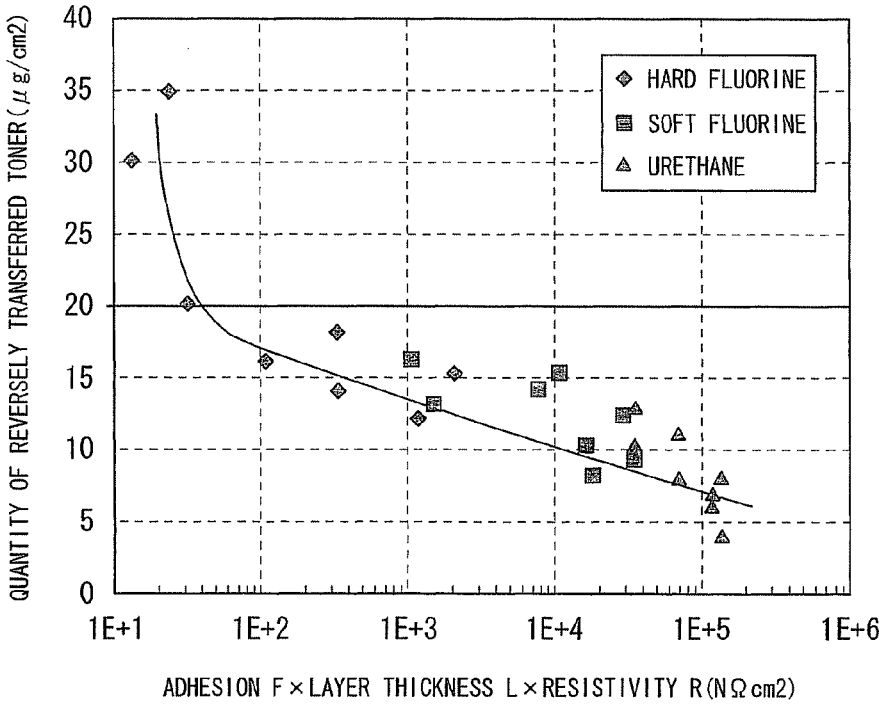
FIG. 6 is a graph showing the quantity of reversely transferred toner with respect to average adhesion F of toner × resistivity R of the intermediate transfer belt × thickness L of the intermediate transfer belt.

FIG. 6 is a graph showing a result of plotting the quantity of reversely transferred toner (μg/cm$^2$) with respect to the average adhesion F (N) of the toner×resistivity R (Ωcm) of the intermediate transfer belt×thickness L (cm) of the intermediate transfer belt.

From this result, there exists a correlation between them, and information such that satisfaction of the following expression contributes to achieve the quantity of reversely transferred toner not more than 20 (μg/cm$^2$) was obtained.

[Expression 4B]

$$40 \ (\mathrm{N\Omega cm^2}) < F \times R \times L \tag{4B}$$

Figure 7:
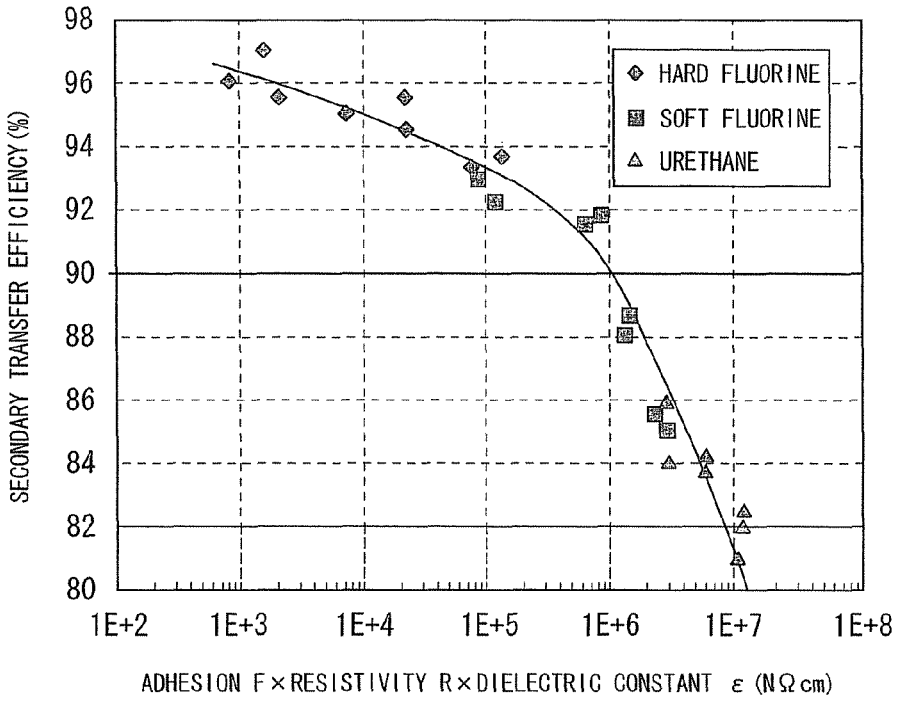
FIG. 7 is a graph showing the secondary transfer efficiency with respect to average adhesion F of toner×resistivity R of the intermediate transfer belt × dielectric constant ∈ of the intermediate transfer belt.
Figure 8:
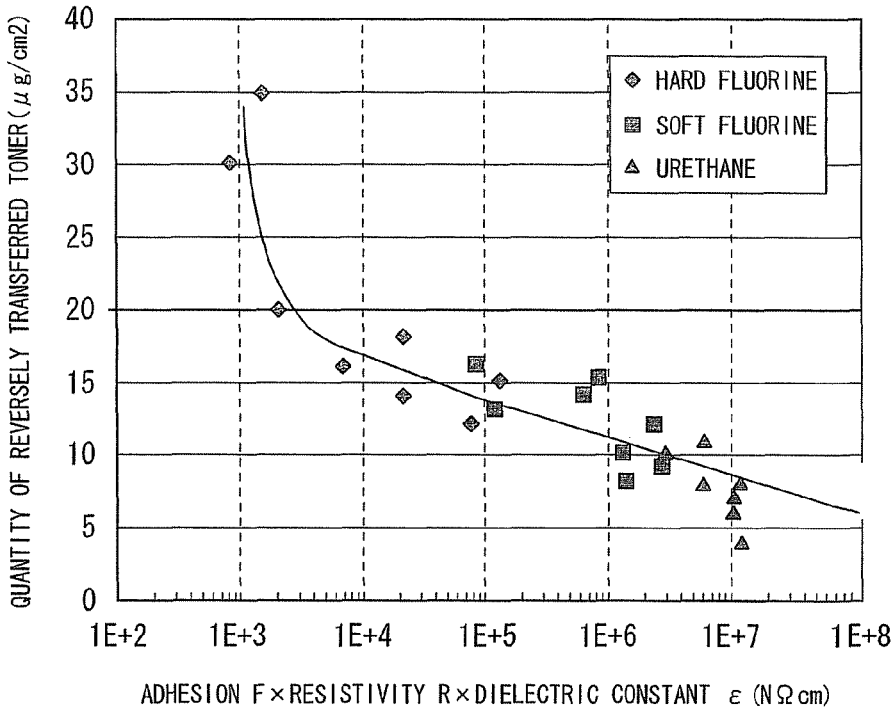
FIG. 8 is a graph showing the quantity of reversely transferred toner with respect to average adhesion F of toner × resistivity R of the intermediate transfer belt × dielectric constant ∈ of the intermediate transfer belt.

FIG. 7 is a graph showing the secondary transfer efficiency with respect to the average adhesion F of the toner×resistivity R of the intermediate transfer belt×dielectric constant ∈ of the intermediate transfer belt. FIG. 8 is a graph showing the quantity of reversely transferred toner with respect to the average adhesion F of the toner×resistivity R of the intermediate transfer belt×dielectric constant ∈ of the intermediate transfer belt.

Here, R×∈ represents a time constant of the belt, which becomes a parameter of the movement of the electric charge. In addition, the correlativities of the reverse transfer and the secondary transfer characteristic with the F×R×∈ are found.

Therefore, it can be said that the image forming apparatus superior in both the secondary transfer characteristics and the reverse transfer characteristics is provided by setting the value of F×R×∈ to an optimal range.

Also, information such that satisfaction of the following expression contributes to achieve a secondary transfer efficiency of 90% or higher and the quantity of reverse transfer not more than 20 (μg/cm$^2$) was obtained.

[Expression 5]

$$2 \times 10^3 \ (\mathrm{N\Omega cm}) < F \times R \times \in < 1 \times 10^6 \ (\mathrm{N\Omega cm}) \tag{5}$$

Figure 9:
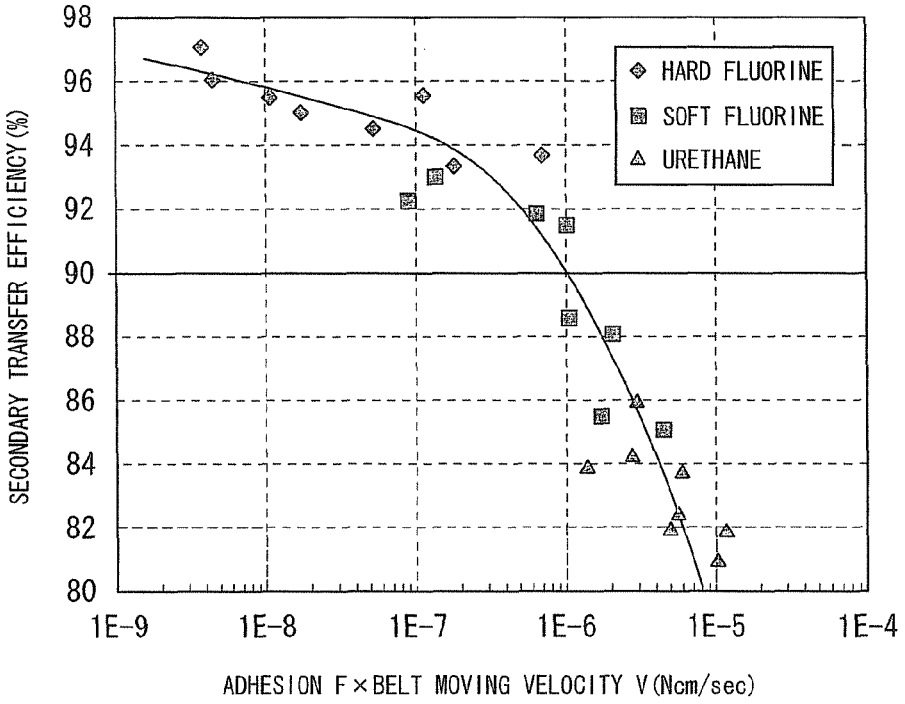
FIG. 9 is a graph showing the secondary transfer efficiency with respect to average adhesion F of toner × moving velocity V of the intermediate transfer belt.
Figure 10:
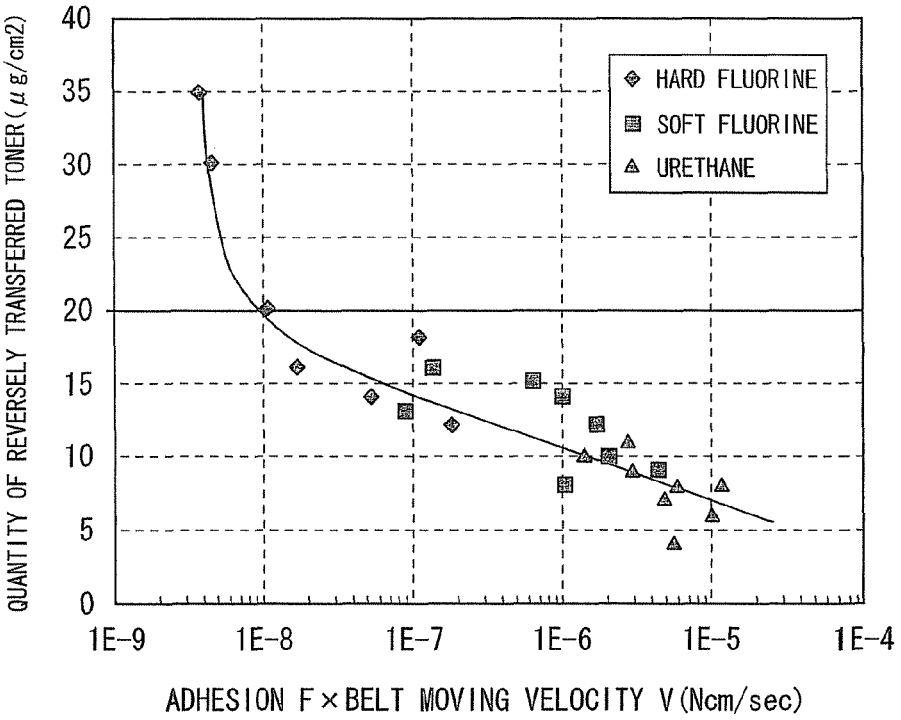
FIG. 10 is a graph showing the quantity of reversely transferred toner with respect to average adhesion F of toner × moving velocity V of the intermediate transfer belt.

FIG. 9 is a graph showing the secondary transfer efficiency with respect to the average adhesion F of the toner×moving velocity V of the intermediate transfer belt. FIG. 10 is a graph showing the quantity of reversely transferred toner with respect to the average adhesion F of the toner×moving velocity V of the intermediate transfer belt.

Since the intermediate transfer belt is moved, the transfer process is a dynamic process, and hence is affected by the moving velocity V (cm/sec).

In order to do so, since the higher moving velocity V is effective for the restraint of the reverse transfer because the injection of the electric charge into the toner can hardly proceed, and the lower moving velocity V is effective for the improvement of the secondary transfer efficiency because the toner must be peeled off in the early stage to allow the movement.

Therefore, it can be said that the image forming apparatus which is able to achieve both the improvement of the secondary transfer characteristics and the restraint of the reverse transfer is provided by setting the value of F×V to an optimal range.

Also, a good correlation was found between the value of F×V and the secondary transfer efficiency and the reverse transfer, and information such that satisfaction of the following expression contributes to achieve the secondary transfer efficiency of 90% or higher and the quantity of reverse transfer not more than 20 (μg/cm$^2$) was obtained.

[Expression 6]

$$1 \times 10^{-8} \ (\mathrm{Ncm/sec}) < F \times V < 1 \times 10^{-6} \ (\mathrm{Ncm/sec}) \tag{6}$$

According to the invention, the image forming apparatus in which the secondary transfer efficiency is improved, the reverse transfer is restrained, the output of images with less quality deterioration is achieved, and the problem of color mixture is solved in the cleaner-less specification, and the related technologies are provided.

In addition, information effective for the change of the image quality with time is provided as a method of evaluating the image forming apparatus. In addition, evaluation of deterioration and estimation of the life time of the intermediate transfer belt are achieved by evaluating the same to be acceptable if any one of the above-described expressions (4AB), (5), and (6), and to be defective if not.

What is claimed is:

1. An intermediate transfer belt used in an image forming apparatus which supports a toner image thereon and transfers the toner image onto an image bearing medium therefrom, satisfying a relational expression (1); 40 (NΩcm$^2$)<F×R×L<1×10$^4$ (NΩcm$^2$), where F(N) is an average adhesion between the intermediate transfer belt and toner, R(Ωcm) is a resistivity, and L(cm) is a thickness of the intermediate transfer belt.

2. An intermediate transfer belt used in an image forming apparatus which supports a toner image thereon and transfers the toner image onto an image bearing medium therefrom, satisfying a relational expression (2); $2\times10^3$ (NΩcm)<F×R×ϵ<$1\times10^6$ (NΩcm), where F(N) is an average adhesion between the intermediate transfer belt and toner, R(Ωcm) is a resistivity, and ∈ is a dielectric constant.

3. An intermediate transfer belt used in an image forming apparatus which supports a toner image thereon and transfers the toner image onto an image bearing medium therefrom, satisfying a relational expression (3); $1\times10^{-8}$ (Ncm/sec)<F×V<$1\times10^{-6}$ (Ncm/sec), where F(N) is an average adhesion between the intermediate transfer belt and toner, and V(cm/sec) is a moving velocity of the intermediate transfer belt.

4. The belt of claim 1, wherein a plurality of layers are laminated.

5. The belt of claim 2, wherein a plurality of layers are laminated.

6. The belt of claim 3, wherein a plurality of layers are laminated.

7. An image forming apparatus, comprising:

a forming portion which forms a toner image on a photoconductive member;

an intermediate transfer belt;

a primary transferring member which transfers the toner image formed on the photoconductive member primarily onto the intermediate transfer belt, and a secondary transferring member which transfers the toner image transferred on the intermediate transfer belt secondarily onto an image bearing medium, wherein a relational expression (1); 40 (NΩcm$^2$)<F×R×L<$1\times10^4$ (NΩcm$^2$) is satisfied, where F(N) is an average adhesion between the intermediate transfer belt and toner, R(Ωcm) is a resistivity, and L(cm) is a thickness of the intermediate transfer belt.

8. An image forming apparatus, comprising:

a forming portion which forms a toner image on a photoconductive member;

an intermediate transfer belt;

a primary transferring member which transfers the toner image formed on the photoconductive member primarily onto the intermediate transfer belt, and a secondary transferring member which transfers the toner image transferred on the intermediate transfer belt secondarily onto an image bearing medium, wherein a relational expression (2); $2\times10^3$ (NΩcm)<F×R×ϵ<$1\times10^6$ (NΩcm) is satisfied, where F(N) is an average adhesion between the intermediate transfer belt and toner, R(Ωcm) is a resistivity, and ϵ is a dielectric constant.

9. An image forming apparatus, comprising:

a forming portion which forms a toner image on a photoconductive member;

an intermediate transfer belt;

a primary transferring member which transfers the toner image formed on the photoconductive member primarily onto the intermediate transfer belt, and a secondary transferring member which transfers the toner image transferred on the intermediate transfer belt secondarily onto an image bearing medium, wherein a relational expression (3); $1\times10^{-8}$ (Ncm/sec)<F×V<$1\times10^{-6}$ (Ncm/sec) is satisfied, where F(N) is an average adhesion between the intermediate transfer belt and toner, and V(cm/sec) is a moving velocity of the intermediate transfer belt.

10. An image forming method applying the intermediate transfer belt of claim 1.

11. An image forming method applying the intermediate transfer belt of claim 2.

12. An image forming method applying the intermediate transfer belt of claim 3.

13. A method of determining an intermediate transfer belt whether or not it corresponds to the intermediate transfer belt of claim 1 and evaluating the performance thereof comprising:

measuring the average adhesion F(N);

inputting the resistivity R (Ωcm) and the thickness L (cm) to the expression (1); and evaluating the intermediate transfer belt to be acceptable if the expression (1) is satisfied and to be defective if not.

14. A method of determining an intermediate transfer belt whether or not it corresponds to the intermediate transfer belt of claim 2 and evaluating the performance thereof comprising:

measuring the average adhesion F(N);

inputting the resistivity R (Ωcm) and the dielectric constant (∈) to the expression (2); and evaluating the intermediate transfer belt to be acceptable if the expression (2) is satisfied and to be defective if not.

15. A method of determining an intermediate transfer belt whether or not it corresponds to the intermediate transfer belt of claim 3 and evaluating the performance thereof comprising:

measuring the average adhesion F(N);

inputting the moving velocity V (cm/sec) to the expression (3); and evaluating the intermediate transfer belt to be acceptable if the expression (3) is satisfied and to be defective if not.

* * * * *